US008262414B1

(12) United States Patent
Li et al.

(10) Patent No.: US 8,262,414 B1
(45) Date of Patent: Sep. 11, 2012

(54) CONNECTOR

(75) Inventors: Jiang Li, Guang-Dong (CN); Ming-Han Lin, New Taipei (TW); Li-Jun Xu, Guang-Dong (CN)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 31 days.

(21) Appl. No.: 13/034,695

(22) Filed: Feb. 24, 2011

(51) Int. Cl.
*H01R 13/648* (2006.01)

(52) U.S. Cl. ..... 439/607.35; 439/607.37; 439/79

(58) Field of Classification Search ..... 439/607.35–607.37, 79
See application file for complete search history.

(56) References Cited

U.S. PATENT DOCUMENTS 6,827,610 B2 * 12/2004 Lin ..... 439/607.37
7,837,506 B1 * 11/2010 Chiang et al. ..... 439/607.27
7,922,535 B1 * 4/2011 Jiang et al. ..... 439/607.35
8,109,791 B2 * 2/2012 Kameyama et al. ..... 439/607.37
8,137,131 B2 * 3/2012 Wang et al. ..... 439/570

* cited by examiner

*Primary Examiner* — Hein Vu
(74) *Attorney, Agent, or Firm* — Cheng-Ju Chiang

(57) ABSTRACT

A connector includes an insulating housing, terminals assembled in the insulating housing, a first shell having a receiving space surrounded by a top plate, two lateral plates and a bottom plate for receiving the insulating housing therein, and a second shell having a base board electrically fixed on the top plate. Two sides of the top plate define two first openings spaced from each other and communicating with the receiving space. A rear side of each first opening extends forward to form an elastic arm with a free end arched downward into the receiving space. Two sides of the base board define two second openings corresponding to the first openings. A rear side of each second opening protrudes forward to form an extending arm resting against a top of the elastic arm for strengthening insertion and extraction strength of the elastic arms acting on a plug connector.

4 Claims, 4 Drawing Sheets

CONNECTOR

BACKGROUND OF THE INVENTION

1. Field of the Invention

The present invention relates to a connector, and more particularly to a connector capable of connecting with a mating connector firmly.

2. The Related Art

A traditional connector includes an insulating housing, a plurality of terminals and a shell. The insulating housing has a base and a tongue extending forward from a front of the base. The terminals are assembled in the insulating housing and further project rearward out of a rear of the base. The shell encloses the insulating housing with the terminals therein and is spaced from the tongue to define an inserting space between the shell and the tongue. The shell has a top plate of which two sides of a front define two openings communicating with the inserting space. A rear side of each opening extends forward into the corresponding opening to form an elastic arm further inclined into the inserting space. When a plug connector is inserted into or pulled out of the inserting space of the connector, the elastic arms provide insertion and extraction strength therefor. However, the insertion and extraction strength only provided by the elastic arms is so little that the plug connector is apt to fall off from the connector in use. As a result, the electrical connection between the plug connector and the connector is often broken off.

SUMMARY OF THE INVENTION

Accordingly, an object of the present invention is to provide a connector which is connected with a printed circuit board (PCB) for mating with a plug connector. The connector includes an insulating housing having a base and a tongue extending forward from a front of the base, a plurality of terminals assembled in the insulating housing respectively and further projecting out of a rear of the base for being soldered with the PCB, a first shell and a second shell. The first shell has a receiving space surrounded by a top plate, two lateral plates and a bottom plate. Two sides of a front of the top plate define a pair of first openings spaced from each other and communicating with the receiving space. A rear side of each first opening extends forward into the corresponding first opening to form an elastic arm with a free end thereof arched downward into the receiving space. The insulating housing is inserted forward in the receiving space with the elastic arms located over the tongue. The second shell has a base board electrically fixed on the top plate of the first shell. Two sides of a front of the base board define a pair of second openings corresponding to the first openings of the first shell. A rear side of each second opening protrudes forward into the corresponding second opening to form an extending arm resting against a top of the corresponding elastic arm for strengthening insertion and extraction strength of the elastic arms acting on the plug connector.

As described above, the first shell encloses the insulating housing therein and then the second shell is fixed on the first shell. The extending arm rests on the corresponding elastic arm to strengthen the insertion and extraction strength when the plug connector is inserted into or pulled out of the connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
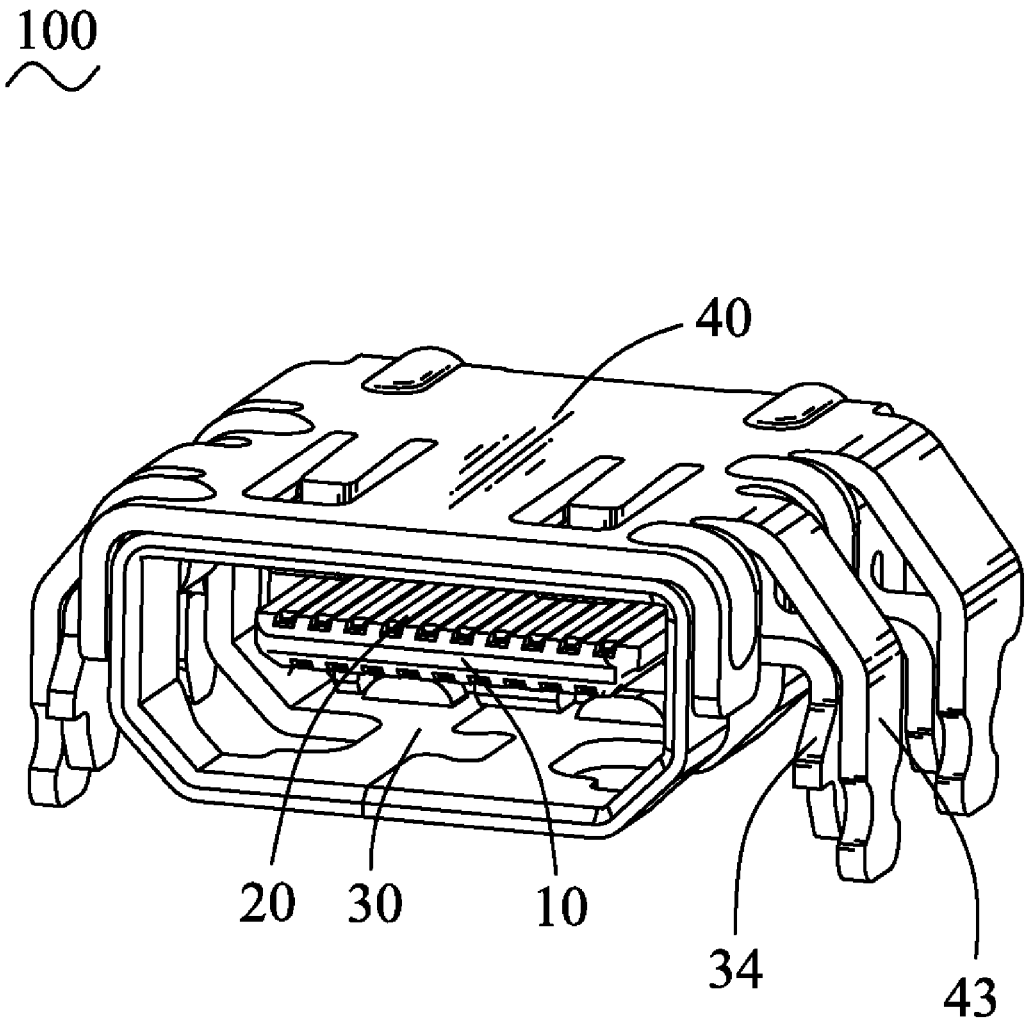
FIG. 1 is an assembled, perspective view of a connector of an embodiment in accordance with the present invention.
Figure 2:
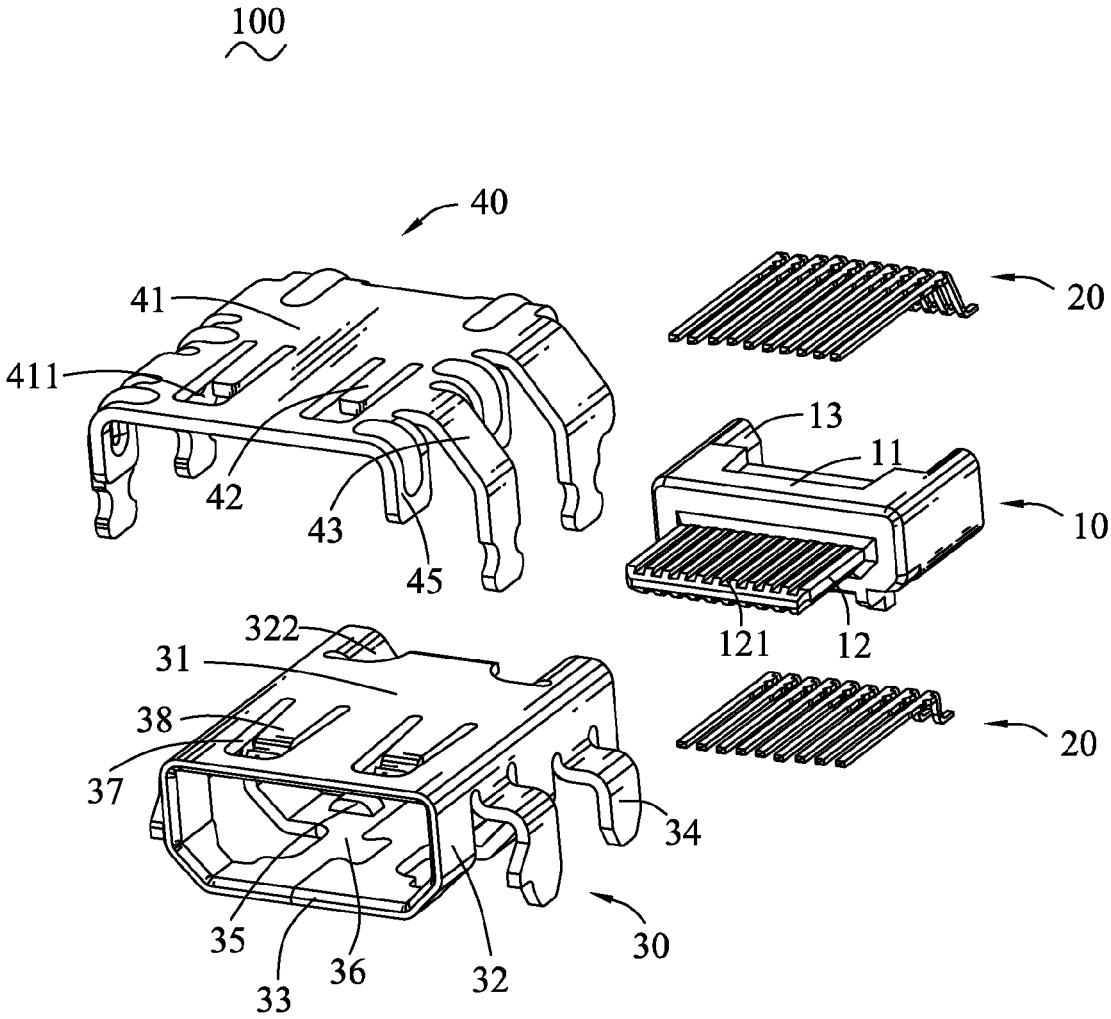
FIG. 2 is an exploded, perspective view of the connector shown in FIG. 1.

Referring to the drawings in greater detail, and first to FIGS. 1-2, the embodiment of the invention is embodied in a connector 100. The connector 100 includes an insulating housing 10, a plurality of terminals 20 assembled in the insulating housing 10, a first shell 30 enclosing the insulating housing 10, and a second shell 40 mounted on the first shell 30.

Figure 3:
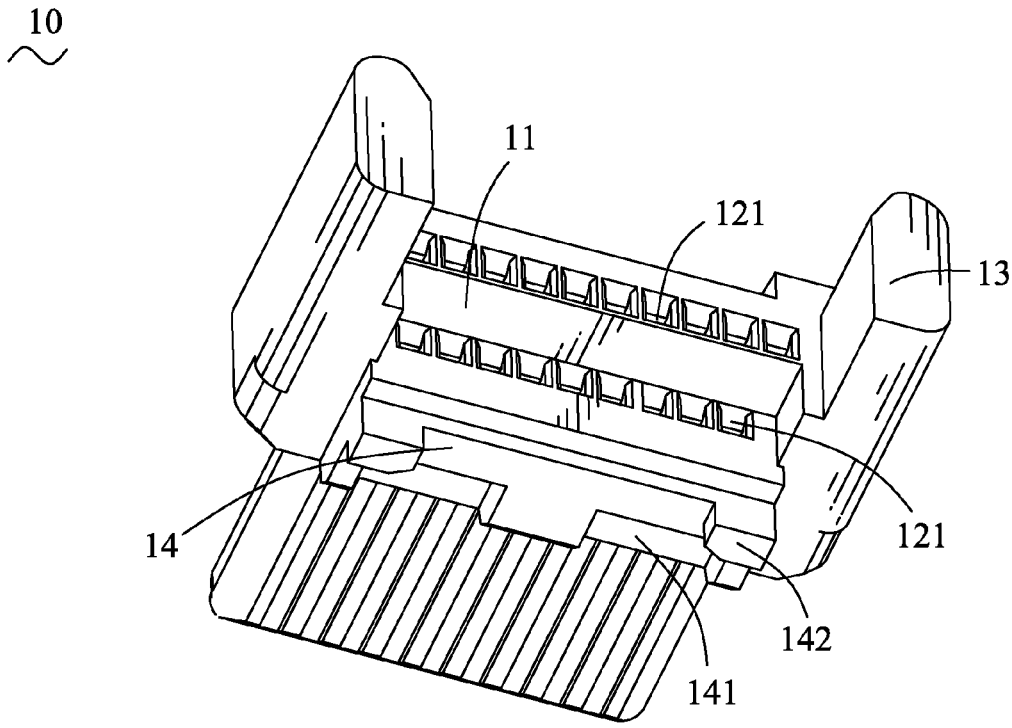
FIG. 3 is a perspective view of an insulating housing of the connector shown in FIG. 2.
Figure 4:
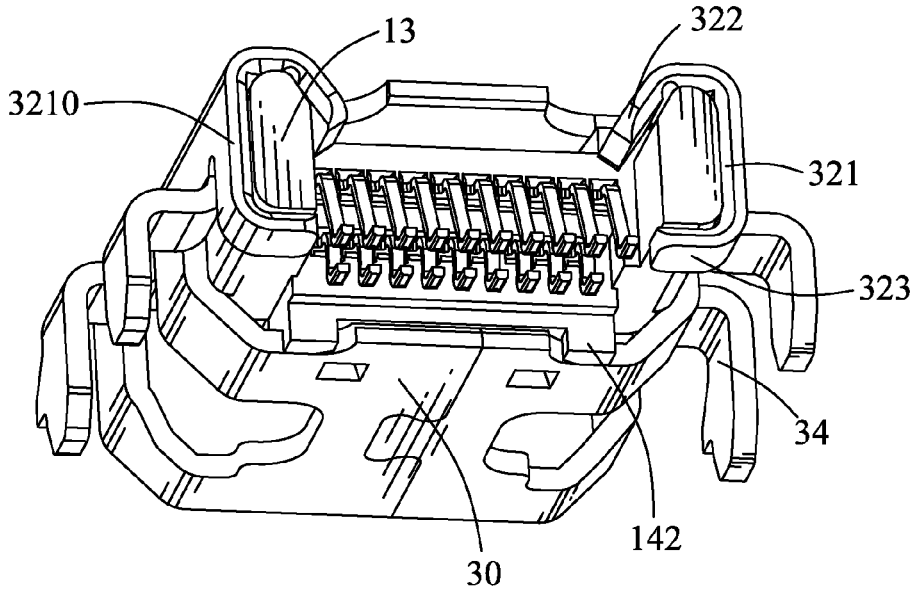
FIG. 4 is a perspective view of the connector shown in FIG. 1 without a second shell, seen from a back view.

With reference to FIGS. 2-3, the insulating housing 10 has a base 11 of substantially rectangular shape. A front of the base 11 extends frontward to form a tongue 12 having a smaller dimension than the base 11. A plurality of terminal grooves 121 is opened at two opposite surfaces of the tongue 12, and each extends frontward and rearward to further penetrate through the base 11. A rear of the base 11 has two opposite ends thereof protruded rearward to form a pair of holding portions 13. A bottom of the base 11 protrudes downward to form a platform 14 extending perpendicularly to the front-to-rear direction of the insulating housing 10. The platform 14 has a front portion thereof recessed upward to form a pair of receiving recesses 141 spaced from each other along the extending direction of the platform 14 and further penetrating through a front of the platform 14. A rear portion of the platform 14 has two opposite ends protruding downward to form a pair of stopping blocks 142.

The first shell 30 has a rectangular top plate 31 of which two opposite side edges extend downward to form a pair of lateral plates 32. Bottoms of the lateral plates 32 extend toward each other to form a pair of bottom plates 33 engaged with each other. The top plate 31, the lateral plates 32 and the bottom plates 33 cooperate with one another to form a receiving space 36 thereamong. Two sides of a front of the top plate 31 define a pair of first openings 37 spaced from each other and communicating with the receiving space 36. A rear side of each first opening 37 extends forward into the corresponding first opening 37 to form an elastic arm 38 with a free end thereof arched downward into the receiving space 36. Two rear edges of the pair of lateral plates 32 extend rearward to form a pair of connecting plates 321 of which two top ends protrude towards each other and then are inclined downward to form two first restricting portions 322 located behind the receiving space 36. Two bottom ends of the pair of connecting plates 321 protrude towards each other to form two second restricting portions 323. The connecting plate 321, the first restricting portion 322 and the second restricting portion 323 together define a fixing structure 3210. Each lateral plate 32 is punched oppositely to the receiving space 36 to form two inverted-L shaped soldering portions 34 spaced from each other along the front-to-rear direction of the lateral plate 32. A rear of each bottom plate 33 protrudes upward to form a bump 35 projecting in the receiving space 36.

Figure 5:
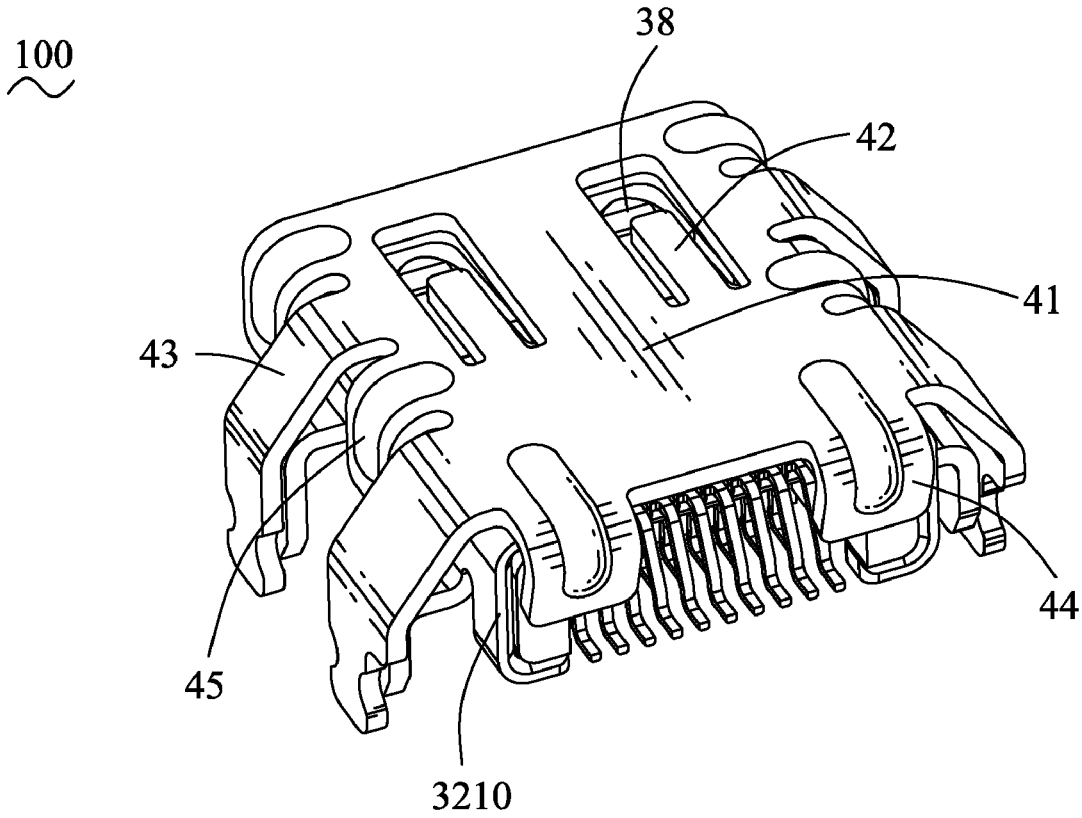
FIG. 5 is an assembled, perspective view of the connector shown in FIG. 1 seen from the back view.

Referring to FIG. 2 and FIG. 5, the second shell 40 has a rectangular base board 41 of which two sides of a front define a pair of second openings 411. A rear side of each second opening 411 protrudes forward into the corresponding second opening 411 to form an extending arm 42 corresponding to the position of the elastic arm 38. Two opposite side edges of the base board 41 extend downward to form a pair of side boards 45. Two portions of each side board 45 are punched outward to slant outward from top to bottom with respect to the side board 45 and then extend downward to form a pair of fixing legs 43. A rear edge of the base board 41 has two opposite ends extending rearward and then bent downward to form two resisting portions 44.

Referring to FIGS. 1-5, in assembly, the terminals 20 are assembled in the terminal grooves 121 of the insulating housing 10 respectively and further project rearward out of the rear of the base 11. Then the insulating housing 10 with the terminals 20 is inserted into the receiving space 36 of the first shell 30, with the bumps 35 buckled in the corresponding receiving recesses 141 and the stopping blocks 142 resting against rear edges of the bottom plates 33 to prevent the insulating housing 10 overly moving forward. The fixing structures 3210 respectively hold the holding portions 13 therein and rest against the rear of the base 11 to prevent the insulating housing 10 moving rearward. So the insulating housing 10 with the terminals 20 can be assembled in the first shell 30 firmly. The elastic arms 38 are located over the tongue 12. The second shell 40 is assembled on the first shell 30 by means of electric welding, with the base board 41 resting on the top plate 31 and the side boards 45 abutting against the corresponding lateral plates 32. The extending arms 42 are located on the corresponding elastic arms 38 to strengthen the elastic arms 38 when a plug connector (not shown) is inserted into or pulled out of the connector 100. The resisting portions 44 resist behind the holding portions 13 and the fixing structures 3210 respectively. The fixing legs 43 are draped over the corresponding soldering portions 34, and then free ends of the soldering portions 34 and the fixing legs 43 are respectively inserted in a printed circuit board (PCB, not shown) for fixing the first shell 30 and the second shell 40 to the PCB.

As described above, the first shell 30 encloses the insulating housing 10 therein and then the second shell 40 is fixed on the first shell 30. The connector 100 is fixed on the PCB by means of the first shell 30 and the second shell 40. So, the connector 100 can be fixed to the PCB firmly. The extending arm 42 rests on the corresponding elastic arm 38 to strengthen insertion and extraction strength when the plug connector is inserted into or pulled out of the connector 100.

What is claimed is:

1. A connector connected with a printed circuit board (PCB) for mating with a plug connector, comprising:

an insulating housing having a base and a tongue extending forward from a front of the base;

a plurality of terminals assembled in the insulating housing respectively and further projecting out of a rear of the base for being soldered with the PCB;

a first conductive shell having a receiving space surrounded by a top plate, two lateral plates and a bottom plate, two sides of a front of the top plate defining a pair of first openings spaced from each other and communicating with the receiving space, a rear side of each first opening extending forward into the corresponding first opening to form an elastic arm with a free end thereof arched downward into the receiving space, the insulating housing being inserted forward in the receiving space with the elastic arms located over the tongue;

a second conductive shell having a base board electrically fixed on the top plate of the first shell, two sides of a front of the base board defining a pair of second openings corresponding to the first openings of the first shell, a rear side of each second opening protruding forward into the corresponding second opening to form an extending arm resting against a top of the corresponding elastic arm for strengthening insertion and extraction strength of the elastic arms acting on the plug connector;

wherein each lateral plate is punched outward to form two inverted-L shaped soldering portions spaced from each other along the front-to-rear direction of the lateral plate, two opposite side edges of the base board extend downward to form a pair of side boards abutting against the lateral plates respectively, two portions of each side board corresponding to the soldering portions are punched outward to slant outward from top to bottom with respect to the side board and then extend downward to form a pair of fixing legs which are draped over the corresponding soldering portions, free ends of the soldering portions and the fixing legs are respectively inserted in the PCB; and wherein the second shell is fixed on the first shell by means of electric welding.

2. The connector as claimed in claim 1, wherein the rear of the base has two opposite ends thereof protruding rearward to form a pair of holding portions, two rear edges of the pair of lateral plates extend rearward to form a pair of connecting plates resisting against outsides of the holding portions respectively, two top ends of the connecting plates protrude towards each other and then are inclined downward to form two first restricting portions wrapping tops of the corresponding holding portions, two bottom ends of the connecting plates protrude towards each other to form two second restricting portions propping against bottoms of the corresponding holding portions, a rear edge of the base board has two opposite ends extending rearward and then bent downward to form two resisting portions resisting behind the holding portions and the first restricting portions respectively.

3. The connector as claimed in claim 1, wherein a bottom of the base protrudes downward to form a platform which has a front portion thereof recessed upward to form a pair of receiving recesses spaced from each other and each penetrating through a front of the platform, a rear of the bottom plate protrudes upward to form two bumps buckled in the receiving recesses respectively.

4. The connector as claimed in claim 3, wherein a rear portion of the platform has two opposite ends protruded downward to form a pair of stopping blocks resisting against a rear edge of the bottom plate.

* * * * *